US008985381B2

(12) United States Patent
Sele et al.

(10) Patent No.: US 8,985,381 B2
(45) Date of Patent: Mar. 24, 2015

(54) TANK FOR FLUID

(75) Inventors: Arne Sele, Hosle (NO); Kåre Dybwad, Billingstad (NO); Michal Stanislaw Przybylski, Asker (NO)

(73) Assignee: Aker Engineering & Technology AS, Lysaker (NO)

( * ) Notice: Subject to any disclaimer, the term of this patent is extended or adjusted under 35 U.S.C. 154(b) by 0 days.

(21) Appl. No.: 14/111,768

(22) PCT Filed: Mar. 13, 2012

(86) PCT No.: PCT/EP2012/054311
§ 371 (c)(1),
(2), (4) Date: Jan. 22, 2014

(87) PCT Pub. No.: WO2012/146435
PCT Pub. Date: Nov. 1, 2012

(65) Prior Publication Data

US 2014/0166663 A1 Jun. 19, 2014

(30) Foreign Application Priority Data

Apr. 29, 2011 (NO) ..... 20110643

(51) Int. Cl.
*B65D 90/02* (2006.01)
*F17C 13/00* (2006.01)
*F17C 1/08* (2006.01)

(52) U.S. Cl.
CPC ..... *F17C 13/002* (2013.01); *F17C 1/08* (2013.01); *F17C 2260/016* (2013.01); *F17C 2270/0105* (2013.01)
USPC ..... 220/560.04; 220/560.05; 220/560.07; 220/560.1; 220/560.17; 222/173

(58) Field of Classification Search
CPC .. F17C 13/002; F17C 1/08; F17C 2270/0105; F17C 2260/016; F17C 13/00; B65D 90/02
USPC ..... 220/560.04, 560.05, 560.07, 560.1, 220/560.12; 222/173
See application file for complete search history.

(56) References Cited

U.S. PATENT DOCUMENTS

| | | | | |
|---|---|---|---|---|
| 4,225,054 | A | 9/1980 | Jean | |
| 2007/0194051 | A1 | 8/2007 | Bakken | |
| 2010/0084407 | A1 * | 4/2010 | Sele et al. | 220/560.1 |

FOREIGN PATENT DOCUMENTS

| | | |
|---|---|---|
| CN | 101014800 | 8/2007 |
| DE | 19934620 | 1/2000 |
| WO | WO2005/085099 A | 9/2005 |

OTHER PUBLICATIONS

CN Search report of Sep. 3, 2014, submitted, inter alia, as statement of relevance of non-English references cited therein.

* cited by examiner

*Primary Examiner* — Elizabeth Volz
(74) *Attorney, Agent, or Firm* — Christian D. Abel

(57) ABSTRACT

A tank for storing fluid, especially hydrocarbons including low temperature liquefied natural gas. The tank comprises tank walls defining an interior tank space, wherein at least one beam is provided in the interior tank space having at least one beam end connected to the tank wall. The at least one recess is provided in the tank wall for receiving the beam end for anchoring to the tank wall.

9 Claims, 3 Drawing Sheets

TANK FOR FLUID

Figure 1A:
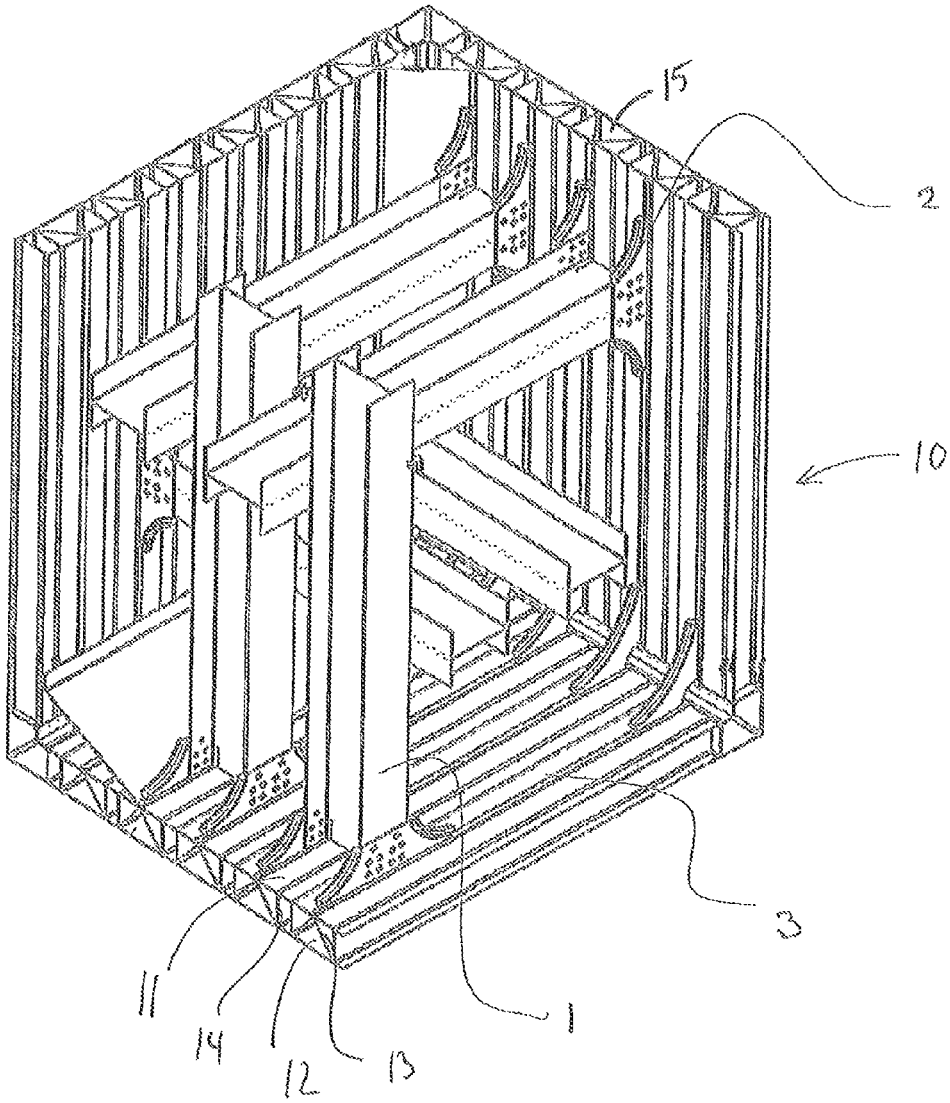

The present invention concerns a tank for fluid, especially hydrocarbons including low temperature liquefied natural gas, as defined in the preamble of the independent claim 1. The tank may be used for storage, distribution and transportation of fluid. The tanks may used for various purposes onboard ships and floating vessels, such as storage and fuelling. Further the tanks may be employed on gravity based offshore structures and land tanks exposed to dynamic loads such as wave loads and loads caused by earth quake. The tank in accordance with the invention may also be applied as a pressure tank, which should be designed to endure the exposure to high internal pressure.

The inventive tank comprises tank walls defining an interior tank space. The tank may be provided having different configurations such as for instance spherical, cylindric, conic and various prismatic shapes. A double wall tank construction is the most common design structure for storage of low temperature liquefied natural gas under pressure, but it may also be used for pressure vessels in general, and this tank may also be the choice for the tank according to the invention. In one aspect the tank wall has a sandwich structure, whereby extruded beam elements are assembled to a sandwich structure.

In order to provide sufficient strength to the tank structure a beam arrangement is positioned in the interior of the tank. The beam arrangement comprises several beams, preferably tension stays, organized orthogonal relative to each other such as in layers. When portions of the fluid have a liquefied state, the beam arrangement in addition reduces the sloshing effect caused by the motion of the ship and the motion of the liquid itself.

The beams each have at least one end connected to the tank wall. The beams may form interconnection points with other beams or each of the beam ends may be connected to a separate tank wall. It has proven advantageous to arrange the beams in the interior tank space in an orthogonal three dimensional pattern.

The beams, or tensions stays, may be extruded or produced from rolled profiles or by any other producing method to produce a beam giving sufficient strength to the tank construction.

Traditionally the tension stays/beams have been welded to the tank walls using friction welding or MIG welding. Welding procedures are time and cost consuming, and a need for solutions providing an alternative to the welding procedure would prove valuable in cutting production cost for manufacturing of the tank.

It is an object of the invention to provide an alternative solution for a robust and reliable connection between the beam and the tank wall. In accordance with a tank as defined in the independent claim a mechanical connection is proposed for attaching the beam to the tank wall. Further embodiments of the invention are defined in the following dependent claims.

In accordance with the tank as defined in the independent claim, at least one beam is provided in the interior tank space having at least one beam end connected to the tank wall.

In one embodiment of the invention the beam end(s) includes a bracket for attachment to the tank wall. The bracket may be connected to the beam end by welding, using bolting or by other suitable means. In this embodiment the bracket will be forming the attachment of the beam end to the tank wall, and the bracket is arranged to be received and anchored in the recess in the tank wall.

At least one recess is provided in the tank wall for receiving the beam end for anchoring to the tank wall. The mouth of the recess opening into the interior tank space has a size to allow for parts of the beam end or the bracket to extend through it, with the end parts of the beam end or the bracket to be received and anchored in the recess.

In one embodiment the recesses are configured so that when positioning the beam end, with or without the bracket into the recess provided in the tank wall, the configuration of the recess, wherein the mouth of the recess is smaller than the profile of the beam end/bracket, provide an anchorage for the beam end locking the beam in place relative to the tank wall. The recess may then be profiled corresponding to the profile of the beam end (or bracket) in accordance with this embodiment. When anchoring the beam to the tank wall, the beam end enters an end portion of the recess and is positioned in the recess at the desired location. The beam is anchored to the tank wall due to the size of the mouth being smaller than the end portion of the beam end/bracket. When the beam end/bracket is installed for anchorage in the recess a portion of the beam end (or bracket) extends out through the mouth of the recess opening into the interior of the tank.

In another embodiment in accordance with the invention the mouth of the recess facing the interior space of the tank, is dimensioned with a size enabling the beam end/bracket to be inserted into the recess from the interior of the tank. To provide anchorage for the beam end to the tank wall, locking means are provided. The locking means may comprise wedge elements to be positioned into the recess by entering through the end portion of the recess or alternatively through the mouth of the recess opening into the tank interior space. The wedging elements have a portion which is larger than the size of the mouth of the recess, thereby providing a wedging effect to the beam end/bracket to anchor the beam to the tank wall.

An example of an embodiment of the invention will be described with reference to the figs where FIG. 1*a* shows a perspective view of the tank structure.

Figure 1B:
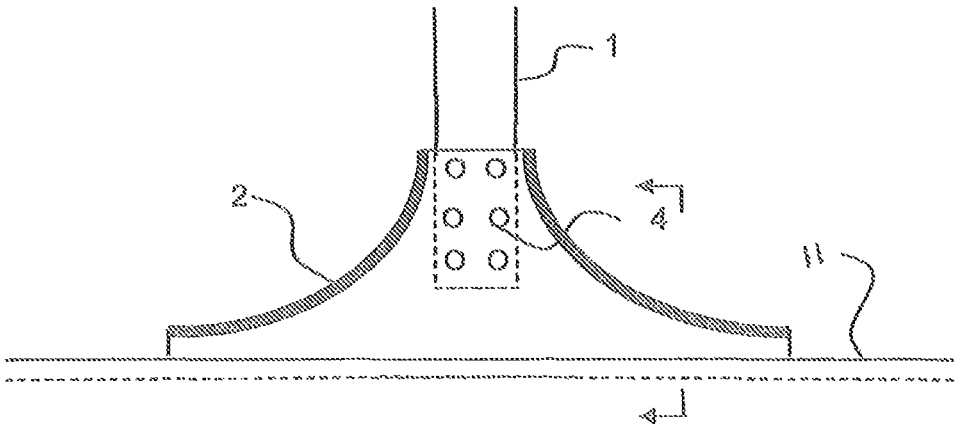

FIG. 1*b* shows the connection of the beam end to the wall in accordance with one embodiment of the invention.

Figure 1C:
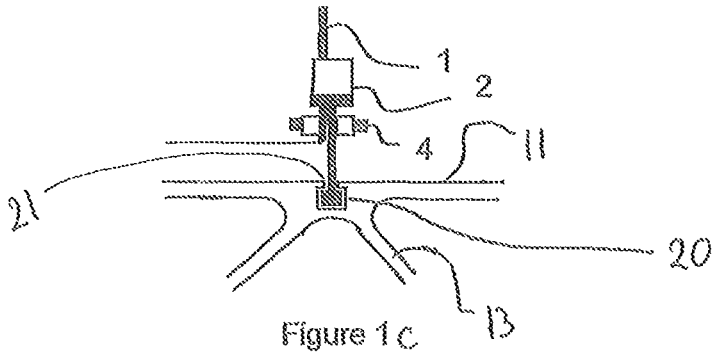

FIG. 1*c* is a section through the bracket and tank wall as indicated by arrows in FIG. 1*b*.

Figure 2A:
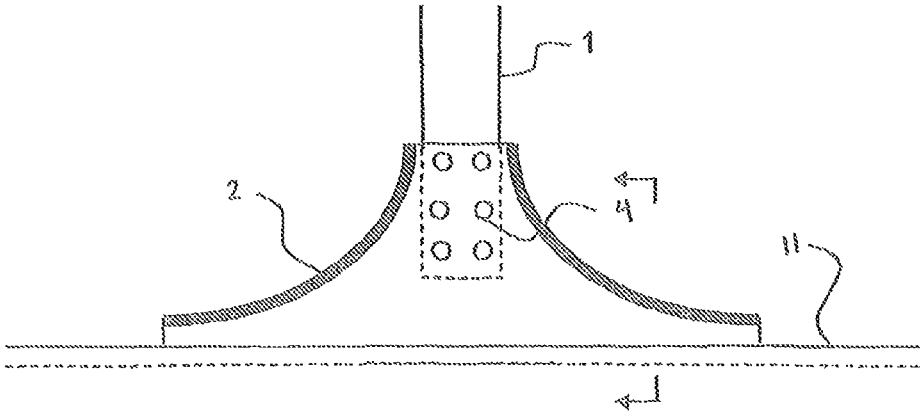

FIG. 2*a* shows the connection of the beam end to the wall in accordance with another embodiment of the invention.

Figure 2B:
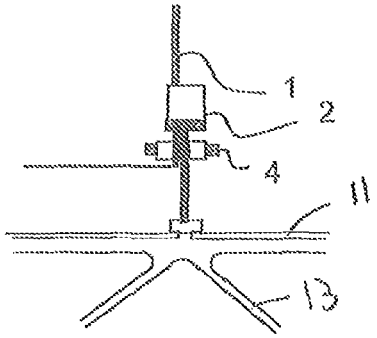

FIG. 2*b* shows a section through the bracket and tank wall as indicated by arrows in FIG. 2*a*.

Figure 3:
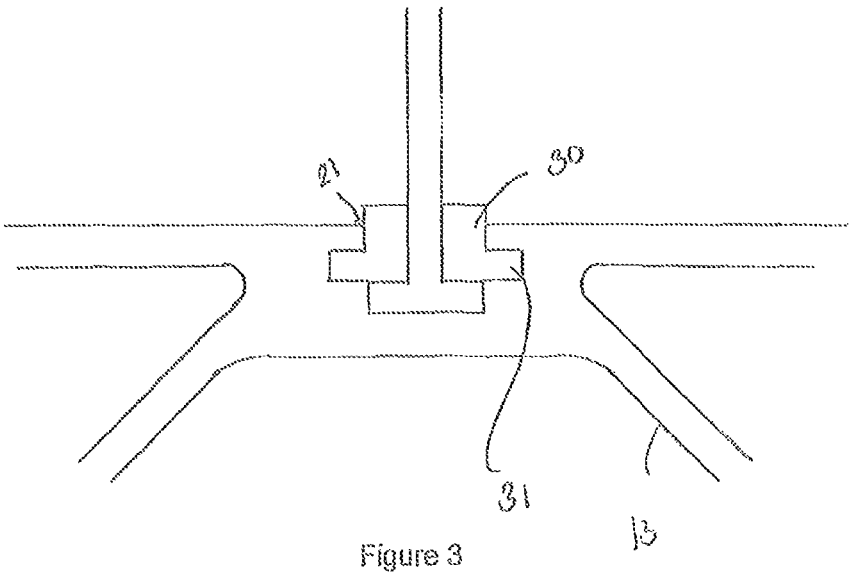

FIG. 3 shows a section through the bracket and tank wall showing the anchorage of the beam end to the wall in detail.

An embodiment of the tank 10 is shown in FIG. 1*a*. The tank is shown having a double wall construction made up by interconnected extruded beam elements 3. The beam elements 3 provide an inner wall 11 and an outer wall 12, and internal wall sections running in between the outer and the inner wall 11, 12. The inner wall sections 13 have an inclined connection to the inner and outer wall 11, 12. And the inner wall sections 14 are perpendicularly connected to the inner and outer wall 11, 12.

As the skilled person will understand, the profile/the cross section of this sandwich construction making up the tank walls may have an outlay different from the one showed in the figure. The inner wall sections may be positioned in various ways providing various profile patterns in accordance with the design criteria of the specific tank. Further, the tank wall may be constituted by beam elements having different or similar profile pattern so that the profile may be uniform or non uniform along the wall. The double wall construction may of course be provided otherwise than by using interconnected extruded beam elements 3.

The tank 10 is provided with beams 1 having an H profile, arranged in the interior space of the tank to strengthen the tank structure to resist load impact working on the structure of the tank. The beams 1 are shown arranged vertically and horizontally in an orthogonal pattern as tension stays. As shown in FIG. 1 one end of the beam is connected to the tank wall and the other beam end is connected in a perpendicular manner to another beam end. A bracket 2 is connected to one end of the beam 1 to be anchored to the wall. The bracket 2 is shown connected to the beam end by the use of bolts 4, and the beam ends are connected using welding.

However, as the skilled person will realize these connections may be provided otherwise, for instance by welding the beam end to the bracket or using bolts connecting the beam ends.

FIGS. 1*b* and 1*c* show the beam 1 with a bracket 2 having a profile fitting into a recess 20 arranged in the tank wall. In the embodiment shown in FIGS. 1*b* and 1*c* the bracket 2 needs to be fitted into the recess 20 with the bracket 2 entering an end portion of the recess as the mouth 21 is too small for the bracket to enter the recess from the interior space of the tank. The small mouth 21 of the recess opening into the interior space of the tank makes sure that the bracket is anchored securely in the tank wall after being installed through the end portion of the recess 20. The recess 20 may run along a portion of the wall or along the entire length of the wall, wherein the end portion of the recess correspond with the end surface 15 of the tank wall. The recess may be made as part of the profile when manufacturing the wall or may be provided as needed after the tank has been completed.

In FIGS. 2*a*, 2*b*, 3 an embodiment of the invention including an alternative anchorage of the beam to the wall, is shown. The mouth 21 of the recess 20 opens into the interior of the tank, and the size of the profile fits into the mouth 21, thereby enabling the bracket to enter the recess from the interior of the tank. Thus in accordance with this embodiment there is no need for the bracket to enter the recess through its end portion as in the embodiment shown in FIG. 1*b*, 1*c*. Locking means, here shown as L-shaped locking wedges 30, are provided to make sure the beam end has anchorage to the tank wall. The locking wedges 30 as shown in FIG. 3 enter the end portion of the recess and are secured in the recess due to the difference between the size of the mouth 21 and locking parts 31 of the locking wedges. As the skilled person may realize the locking means may comprise one or more elements, and the locking wedges may be provided to enter the recess through the mouth 21, wherein the locking wedges in this case have a configuration different from that shown in FIG. 3.

The anchorage of the beam end to the wall has herein been described having a bracket fitted to the beam end, as the skilled person will realize, these descriptions will also apply to the aspect of the invention where the beam end is not provided with a bracket, but where the beam end is arranged to be anchored directly to the tank wall.

The invention claimed is:

1. A tank for hydrocarbons including low temperature liquefied natural gas, wherein the tank comprises tank walls defining an interior tank space, wherein at least one beam is provided in the interior tank space having at least one beam end connected to the tank wall, further wherein at least one recess is provided in the tank wall for receiving the at least one beam end for anchoring to the tank wall and the at least one beam end includes a bracket to be received and anchored in the at least one recess in the tank wall.

2. A tank in accordance with claim 1, wherein the at least one recess has a configuration providing anchorage for the at least one beam end.

3. A tank in accordance with claim 1 or 2, wherein the at least one recess has a mouth in the tank wall facing the interior space of the tank, wherein a profile of the at least one beam end to be received in the at least one recess fits into the size of mouth.

4. A tank in accordance with claim 3, wherein locking means are provided for anchoring the at least one beam end to the tank wall.

5. A tank in accordance with claim 4, wherein the locking means are constituted by at least one wedge element to be inserted into the at least one recess securing the at least one beam end to the tank wall.

6. A tank in accordance with claim 5, wherein the locking means is provided to be inserted through the mouth or an end portion of the at least one recess.

7. A tank in accordance with claim 1, wherein the at least one recess has a profile corresponding to a profile of the at least one beam end and the mouth of the at least one recess is sized smaller than an end portion of the at least one beam end, wherein the at least one beam end is to enter the at least one recess through an open end portion of the at least one recess.

8. A tank in accordance with claim 1, wherein the tank walls have a double wall construction providing the tank wall with an inner and outer wall.

9. A tank in accordance with claim 1, wherein a plurality of beams are arranged in the interior tank space in an orthogonal three dimensional pattern.

* * * * *